US005489203A

United States Patent [19]

Döbbeling et al.

[11] Patent Number: 5,489,203

[45] Date of Patent: Feb. 6, 1996

[54] METHOD OF OPERATING A PREMIXING BURNER

[75] Inventors: Klaus Döbbeling, Nussbaumen; Hans P. Knöpfel, Besenbüren; Thomas Sattelmayer, Mandach, all of Switzerland

[73] Assignee: ABB Research Ltd., Zurich, Switzerland

[21] Appl. No.: 292,268

[22] Filed: Aug. 18, 1994

[30] Foreign Application Priority Data

Sep. 6, 1993 [DE] Germany ..... 43 30 083.9

[51] Int. Cl.[6] ..... F24C 5/00

[52] U.S. Cl. ..... 431/173; 431/284; 431/354

[58] Field of Search ..... 431/8, 173, 284, 431/351, 350, 354

[56] References Cited

U.S. PATENT DOCUMENTS

| | | | |
|---|---|---|---|
| 3,217,779 | 11/1965 | Reed et al. . | |
| 5,085,575 | 2/1992 | Keller | 431/354 |
| 5,127,821 | 7/1992 | Keller | 431/351 |
| 5,240,409 | 8/1993 | Xiong | 431/354 |
| 5,244,380 | 9/1993 | Dobbeling | 431/354 |

FOREIGN PATENT DOCUMENTS

680467A5 8/1992 Switzerland .

*Primary Examiner*—James C. Yeung
*Attorney, Agent, or Firm*—Burns, Doane, Swecker & Mathis

[57] ABSTRACT

A premixing burner (X) which consists essentially of at least two hollow partial bodies (1, 2), which are positioned one above the other and whose center lines (1*b*, 2*b*) extend offset relative to one another in the longitudinal direction of the partial bodies (1, 2), is employed for hot gas generation, for example in a firing plant. Due to this offset, tangential inlet slots (21, 22) respectively occur through which a combustion airflow (15) flows into the internal space (14) of the premixing burner (X). Venturi mixers (32) with fuel nozzles (36), through which a fuel (31) is introduced into the combustion air (15) flowing past at this point, are arranged in the region of these tangential inlet slots (21, 22).

9 Claims, 2 Drawing Sheets

METHOD OF OPERATING A PREMIXING BURNER

BACKGROUND OF THE INVENTION

1. Field of the Invention

The present invention is directed to a premixing burner and a method for operating the premixing burner of the invention.

2. Discussion of Background

In view of the extremely low $NO_x$, CO and UHC emissions specified for the operation of a heat generator, it has become practice to replace diffusion combustion by a premixing distances and, correspondingly, by premixed combustion. A premixing burner of this type is disclosed in EP-0 321 809. The disclosure of this publication involves replacing the conventional premixing distances by a premixing burner which essentially consists, in the flow direction, of at least two hollow partial conical bodies positioned one upon the other, the center lines of these partial bodies extending offset relative to one another. By this means, tangential entry slots are formed along the premixing burner formed in this way and these entry slots are opposite to one another with respect to the flow. There is an airflow through them into the internal space of the premixing burner. The formation of the mixture—from fresh air, possibly enriched by a quantity of recycled exhaust gas, and fuel—for the formation of a combustion airflow takes place in such a way that the premixing burner can have different fuel inlet nozzle arrangements. A first possibility consists in at least one fuel nozzle being provided at the beginning of the premixing burner, i.e. in the region of its smallest cross-section. This fuel nozzle is placed centrally relative to the center lines of the partial bodies extending offset relative to one another. A further fuel inlet nozzle arrangement, which can either be operated individually or is in effective connection with the fuel nozzle previously mentioned, is made available by providing a series of fuel nozzles along the tangential inlet slots at the transition to the internal space. As an example, the injection of a liquid fuel through the centrally placed nozzle takes place in such a way that a conical spray-type fuel column, which does not, however, wet the inner walls of the hollow conical space, forms in the flow direction of the premixing burner. This fuel column is surrounded by the airflow flowing into the internal space—and, if necessary, by a further axially introduced airflow—in such a way that mixture formation takes place within the premixing burner. This mixture is ignited at the outlet from the premixing burner and stabilization of the flame front is induced in the region of this burner mouth by a reverse flow zone which forms there.

If, however, fuels with a high hydrogen content are burned in such a premixing burner, problems occur with the flame stabilization explained above. Due to the higher flame speed of the hydrogen, transition occurs in the burner from premixing operation to diffusion operation. This causes the following problems:

the burner overheats, the $NO_x$ emissions increase greatly, pulsations occur in the transition range between diffusion and premixing operation.

SUMMARY OF THE INVENTION

Accordingly, one object of this invention, as claimed in the claims, is to provide a remedy and to provide novel means—in a method and in a burner, for carrying out the method, of the type described at the beginning—which ensure stable premixing combustion with the lowest possible level of turbulence and minimized $NO_x$ emissions.

In the present invention, the remedy is achieved by the introduction at a suitable position of a venturi mixer which is fitted in the combustion airflow upstream of the internal space of the burner. The venturi mixer can then be extended by means of a cooling airflow. This type of layout offers large advantages, particularly where the fuel has high hydrogen proportions. The fuel is then introduced at a position where the maximum combustion air velocity is present.

Further advantages of the invention may further be seen in that, in particular, the fuel injection location is in the region of the venturi section; there is a relatively high combustion air velocity at this point so that rapid and comprehensive mixing of the fuel added takes place with the other medium.

Furthermore, the lower flame velocities at the outlet from the burner can induce better flame stability, i.e. initiate smaller pulsations.

Good mixture formation between the fuel and the air can be achieved with low pressure loss by means of the venturi mixer.

The invention has, furthermore, another essential advantage which consists in the fact that it is not necessary to provide a premixing distance above the tangential entry slots for a fuel introduced there so that the original compactness of the burner is not lost due to the extension to fuels with a high hydrogen content.

The invention also dispenses with the need to increase the fuel pressure—for the purpose of aiding better mixture formation—before the fuel is introduced. This increase in pressure is always needed for conventional premixing distances.

Further advantages with respect to minimizing the turbulence in the region of the inlet slots leading to the internal space of the burner occur if the venturi mixer is placed precisely in the region of these inlet slots or can develop its effect there.

Advantageous and expedient further developments of the solution to the object of the invention are described in the further dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
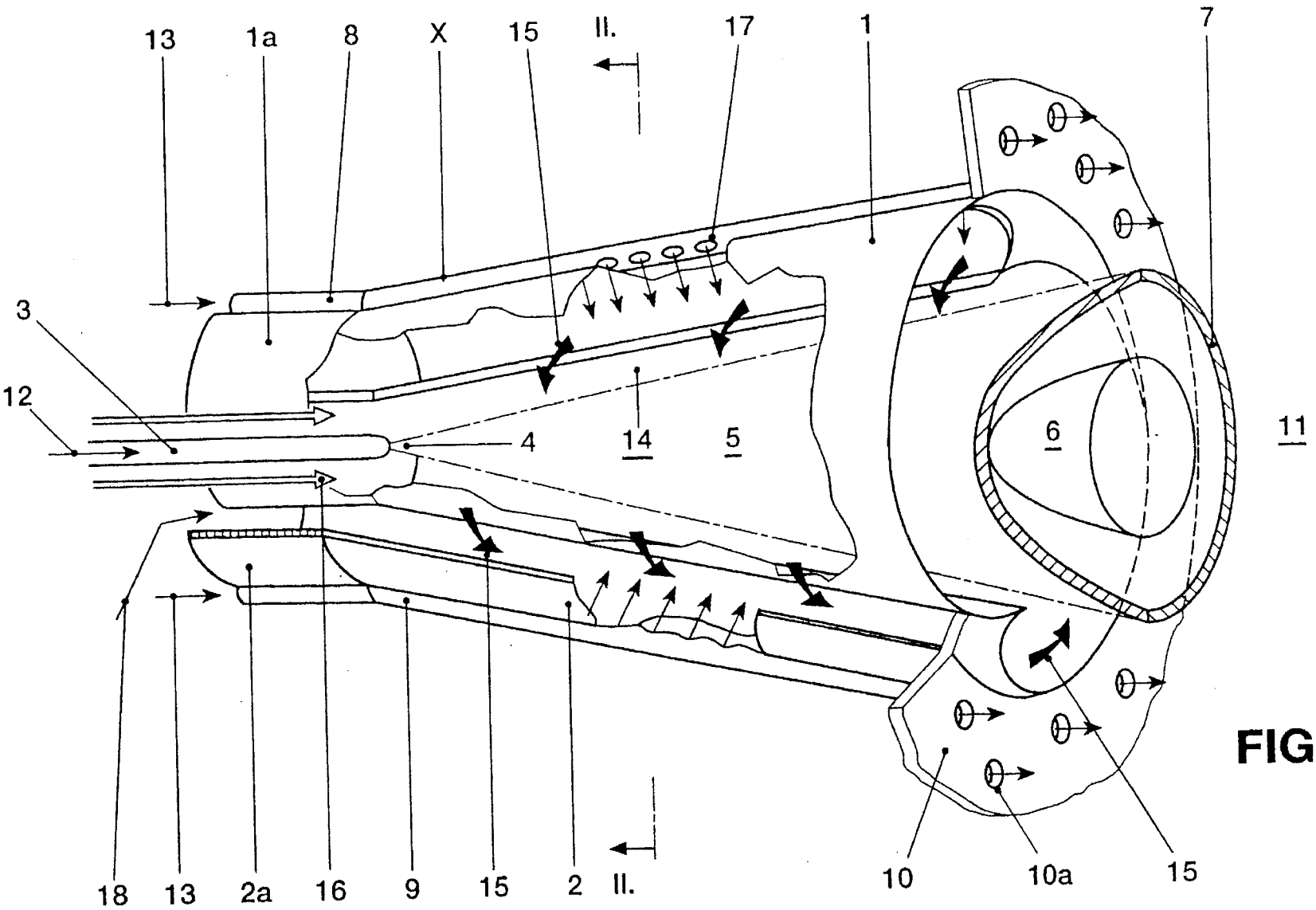
FIG. 1 shows, in a perspective representation appropriately sectioned, a premixing burner in the form of a double-cone burner, only the main body of the premixing burner being visible in this figure.
Figure 2:
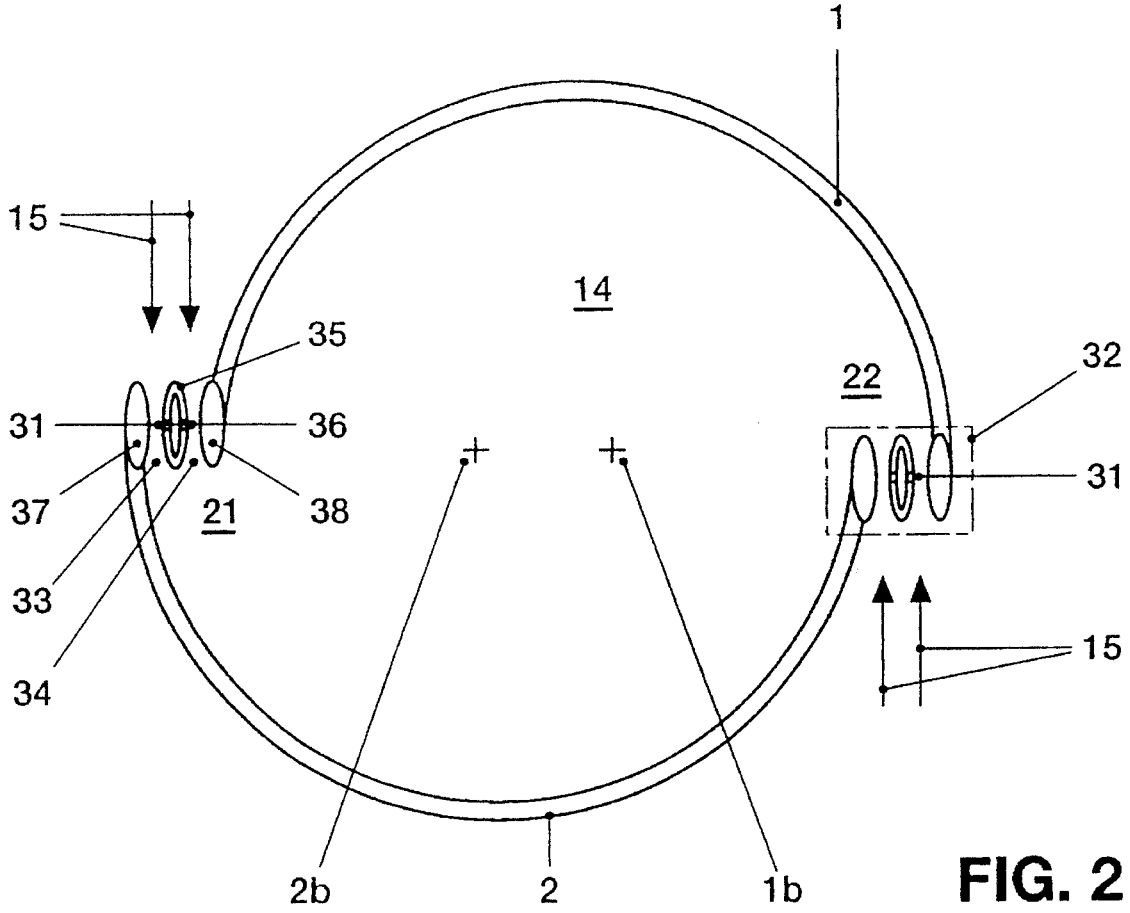
FIG. 2 shows a section through the plane II—II of FIG. 1
Figure 3:
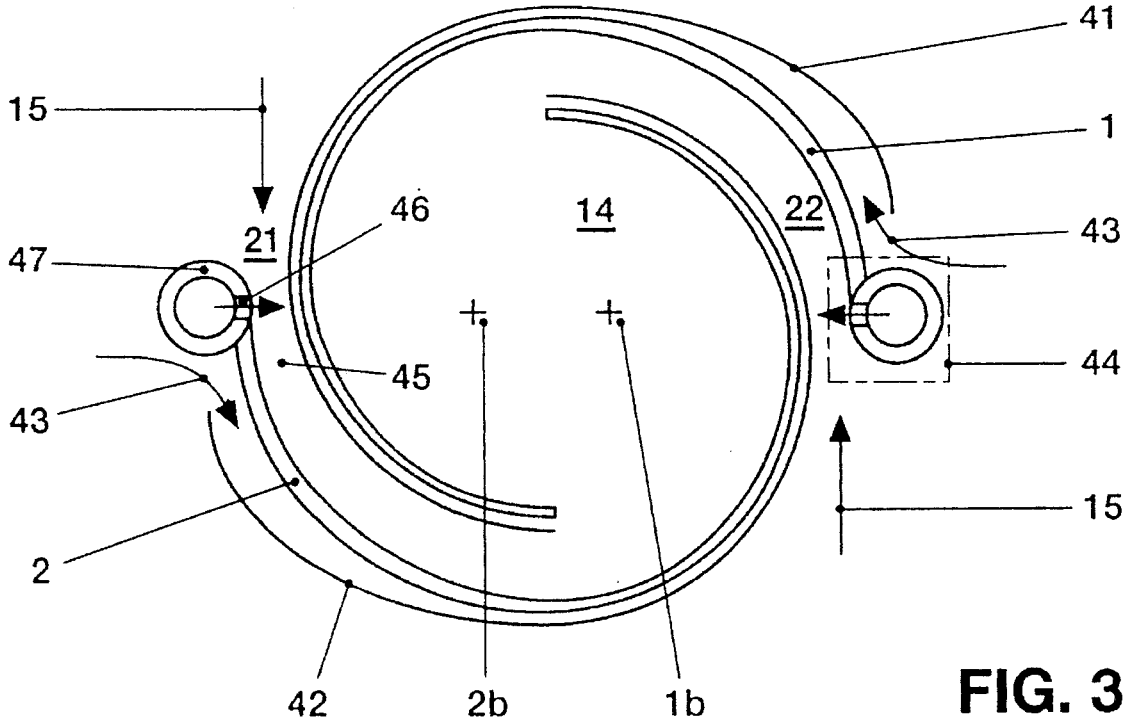
FIG. 3 shows a further embodiment of the combustion air supply above the tangential entry slots.

Referring now to the drawings, all elements not necessary for immediate understanding of the drawing are omitted, and the flow direction of the media is indicated by arrows and wherein like reference numerals designate identical or corresponding parts throughout the several views. It is advantageous to refer simultaneously to FIG. 1, FIG. 2 and, if need be, also FIG. 3—which show a radial section through the premixing burner X—in order to gain better understanding of the construction of the premixing burner X. In order not to make FIG. 1 unnecessarily difficult to understand, furthermore, the combustion air supply and the venturi mixers in the region of or above the tangential air inlet slots, which are illustrated in FIG. 2 and 3, are not shown in FIG. 1. In the description of FIG. 1, reference is also made below to the other figures where required for clarity.

The premixing burner X of FIG. 1 consists of two semi-conical partial bodies 1, 2 which are located one upon the other and offset relative to one another. It is understood that the number of partial conical bodies necessary for forming the premixing burner X is not limited to two. The conical shape of the partial bodies 1, 2 shown has a certain fixed angle in the flow direction. The partial bodies 1, 2 can have a different opening configuration in the flow direction, for example a regularly or irregularly increasing conical inclination which leads, pictorially, to an approximately trumpet shape, or a regularly or irregularly decreasing conical inclination which leads, pictorially, to an approximately tulip shape. The two shapes last mentioned are not included in the drawing because they can be readily visualized. The form which is finally selected depends on the various parameters of the particular combustion process.

The offset of the respective center lines 1*b*, 2*b* of the partial conical bodies 1, 2 relative to one another creates respective tangential air inlet slots 21, 22 (FIG. 2 and 3) on both sides in an axisymmetrical arrangement and frees an axial inlet flow cross-section 18 through which the combustion air, 15, 16, consisting of fresh air or a mixture of fresh air and combustion gas, flows into the internal space 14 of the premixing burner X. The two partial conical bodies 1, 2 have respective cylindrical initial parts 1*a*, 2*a* which likewise extend offset in a manner analogous to the partial bodies 1, 2 so that the tangential air inlet slots 21, 22 are present over the complete length of the premixing burner X.

The premixing burner X can be configured to be purely conical, i.e. without cylindrical initial parts 1*a*, 2*a*. At least one fuel nozzle 3 is accommodated within this cylindrical initial part 1*a*, 2*a* and this is, for example, particularly suitable as the seating for anchoring the complete premixing burner X.

If required, both partial bodies 1, 2 have a fuel conduit 8, 9, which extends in the axial direction and which is provided with a number of nozzles 17. A preferably gaseous fuel 13 is guided through these conduits and this gaseous fuel 13 is added through the nozzles 17 mentioned in the region of the tangential air inlet slots 21, 22 (see FIG. 2) to the combustion air 15 which flows through these slots. It is therefore also possible to operate the premixing burner X by means of the fuel supplied via the nozzle 3 alone or via the nozzles 17. Mixed operation by means of both nozzles 3, 17 is possible, in particular where different fuels are to be supplied by means of the individual nozzles.

At the combustion space end 11, the premixing burner X has a collar-shaped plate 10 which has a number of holes 10*a* through which dilution or cooling air is supplied to the front part of the premixing burner X.

If a liquid fuel is supplied via the nozzle 3, this fuel is injected with an acute spray angle into the internal space 14 of the premixing burner X in such a way that a spray pattern 5 which is, as far as possible, homogeneously conical occurs as far as the burner outlet plane. The fuel inlet nozzle arrangement can be an air-supported nozzle or a nozzle which operates in accordance with a pressure atomization principle. The conical spray pattern 5 is surrounded by tangentially entering combustion airflows 15, corresponding to the number of air inlet slots 21, 22, and by the axially introduced further combustion air 16.

The concentration of the fuel 12, which has been introduced, is continuously reduced in the flow direction of the premixing burner X by the combustion airflows 15, 16 already mentioned. If a gaseous fuel 13 is introduced in the region of the tangential inlet slots 21, 22, the formation of the mixture with the combustion air 15 has, generally speaking, already commenced in this region. When a liquid fuel 12 is used, the optimum, homogeneous fuel concentration over the cross-section is achieved in the region where the vortex collapses, i.e, in the region of the return flow zone 6 at the end of the premixing burner X.

The ignition of the fuel/combustion air mixture begins at the apex of the reverse flow zone 6. It is only at this point that a stable flame front 7 can occur. A flash-back of the flame into the premixing burner X—as is always to be feared in the case of the previously revealed premixing distances and against which a remedy is sought in such cases by means of complicated flameholders—need not be feared in the present case.

If the combustion air 15, 16 is preheated, however, accelerated overall evaporation of the liquid fuel 12 takes place before the point at the outlet from the premixing burner X is reached at which ignition of the mixture takes place. The degree of evaporation depends on the size of the premixing burner X, on the droplet size of the injected fuel 12 and on the temperature of the combustion airflows 15, 16 and their intensity. Minimization of the pollutant emissions also depends to an important extent on the exhaust gas recirculation, which contributes to the possibility of complete evaporation of the fuel taking place before entry to the combustion zone.

When designing the partial conical bodies 1, 2 in terms of conical inclination and width of the tangential air inlet slots 21, 22, it is advantageous to maintain close limits at this point so that the desired flow field of the combustion air with its reverse flow zone 6 in the region of the mouth of the premixing burner X for flame stabilization is established. In general, it may be stated that decreasing the size of the air inlet slots 21, 22 displaces the reverse flow zone 6 further upstream although in that case the mixture ignites earlier. However, it should be stated that the reverse flow zone 6 is intrinsically stable positionally once its location has been fixed because the swirl number increases in the flow direction in the conical shape region of the premixing burner X.

Furthermore, the axial velocity of the mixture can be influenced by the axial supply, already mentioned, of combustion air 16. The construction of the premixing burner X is eminently suitable for modifying the gap width of the tangential air inlet slots 21, 22 in the case of a specified design length of the burner which is not to be exceeded. This is because the partial conical bodies 1, 2 can be displaced towards or away from one another so that, as a result, the distance between the two center lines 1*b*, 2*b* is respectively reduced or increased, as can be easily derived from FIG. 2. It is also easily possible to displace the partial conical bodies 1, 2 into one another by a rotary motion. Given appropriate arrangements, it is therefore possible to vary the shape and the size of the tangential air inlet slots 21, 22 during operation so that the same premixing burner X can cover a wide functionality without the installation length being changed.

As already stated above, problems with respect to flame stabilization occur during the operation of the premixing burner X with a fuel having a high hydrogen content. For this reason, the premixing burner X is to be extended in the region of the tangential air inlet slots 21, 22. These extensions are represented in the subsequent FIGS. 2 and 3, the original introduction of fuel via the nozzles 17 (see FIG. 1) being dispensed with in these embodiments. It is understood that it still remains possible to put the fuel nozzle 3 into operation.

As shown in FIG. 2, the fuel 31 is introduced at the location of maximum velocity of the combustion air-flow 15, i.e. again in the region of the tangential air inlet slots 21, 22. In this region, a venturi mixer 32 is provided over the complete and length of the premixing burner. This venturi mixer 32 consists of a double passage, i.e. of tangential flow paths 33, 34. The central venturi body 35 is simultaneously used as the fuel supply conduit. In addition, it is provided with nozzles 36 on both sides in the direction towards the flow paths 33, 34 mentioned. The flow paths 33, 34 develop a venturi effect because the two other adjacent bodies 37, 38 are likewise configured in venturi fashion. This simple division of the venturi mixer 32 has itself the effect that the design length of the mixture-forming region can be effectively minimized without having to omit the advantages of individual venturi sections. This division can be a multiple and can also be embodied as a venturi matrix (not shown). In the case of the possible embodiment last mentioned, this involves occupying the flow path into the internal space 14 of the premixing burner X with a large number of small tubular venturis.

FIG. 3 differs fundamentally from FIG. 2 in that the partial conical bodies 1, 2 are extended by additional guide plates 41, 42 which permit an additional cooling airflow 43 which inter alia cools the partial bodies 1, 2. In the case of the venturi mixer 44 shown here, a simple venturi-type flow path 45 is formed opposite the combustion air 15 so that, again, the fuel nozzles 46 only act on the flow path 45. A different venturi effect occurs with respect to the cooling airflow 43. The venturi body 47 is, here again, configured as a fuel supply pipe.

In general, it is postulated that, independent of their embodiment, the venturi mixers 32, 44 are fitted upstream of the internal space 14 of the premixing burner X.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A premixing burner, comprising:

at least two hollow partial bodies positioned adjacent to define a interior space, longitudinal centerlines of each of the bodies being offset so that the bodies define longitudinally extending inlet slots for tangentially directed flow of combustion air into the interior space, the bodies being open at an axial inlet end for an axial flow of combustion air;

a venturi mixer comprising two elongate bodies, one body mounted on each of the partial bodies at the inlet slots, and a third elongate body disposed in the inlet slot between the elongate bodies mounted on the partial bodies to form two longitudinal flow paths in the inlet slots; and at least one fuel nozzle positioned in the venturi mixer and directed to inject fuel in the venturi section at a location of maximum combustion air flow velocity.

2. The premixing burner as claimed in claim 1, wherein the premixing burner further comprises at least one of a fuel nozzle placed at the axial inlet end and a plurality of fuel nozzles arranged in the tangential inlet slots.

3. The premixing burner as claimed in claim 1, further comprising means for introducing a gaseous fuel through the fuel nozzle in the region of the venturi mixer, means for introducing a liquid fuel through the fuel nozzle arranged at the axial inlet end and means for introducing a gaseous fuel through the plurality of fuel nozzles in the tangential inlet slots.

4. The premixing burner as claimed in claim 1, wherein the partial bodies have a uniformly increasing flow cross-section in the flow direction.

5. The premixing burner as claimed in claim 1, wherein the partial bodies have a non-uniformly increasing flow cross-section in the flow direction.

6. The premixing burner as claimed in claim 1, wherein the partial bodies have a uniformly decreasing flow cross-section in the flow direction.

7. The premixing burner as claimed in claim 1, wherein the partial bodies have a non-uniformly decreasing flow cross-section in the flow direction.

8. The premixing burner as claimed in claim 1, wherein the venturi mixer is directed to inject fuel perpendicular to a flow direction of the tangentially inflowing combustion air.

9. The premixing burner as claimed in claim 1, wherein two fuel nozzles are mounted in the third elongate body, one nozzle directed to each of the flow paths.

* * * * *